United States Patent [19]

Krafft et al.

[11] Patent Number: 5,070,006

[45] Date of Patent: Dec. 3, 1991

[54] PHOTOGRAPHIC MATERIAL COMPRISING AN NC LAYER

[75] Inventors: Werner Krafft, Leverkusen; Günter Helling, Odenthal; Günter Matschke, Leichlingen, all of Fed. Rep. of Germany

[73] Assignee: Agfa Gevaert AG, Leverkusen-Bayerwerk, Fed. Rep. of Germany

[21] Appl. No.: 692,280

[22] Filed: Apr. 26, 1991

[30] Foreign Application Priority Data

May 11, 1990 [DE] Fed. Rep. of Germany ..... 4015161

[51] Int. Cl.[5] ..... B03C 1/76

[52] U.S. Cl. ..... 430/531; 430/523; 430/527; 430/908; 430/961; 430/930

[58] Field of Search ..... 430/523, 531, 961, 908, 430/919, 930, 527

[56] References Cited

U.S. PATENT DOCUMENTS

| | | | |
|---|---|---|---|
| 4,388,402 | 6/1983 | Mukunoki et al. | 430/531 |
| 4,729,945 | 3/1988 | Anthonsen et al. | 430/531 |
| 4,939,077 | 7/1990 | Helling et al. | 430/531 |

*Primary Examiner*—Jack P. Brammer

*Attorney, Agent, or Firm*—Connolly and Hutz

[57] ABSTRACT

A photographic recording material comprising a support, at least one photosensitive, gelatine-containing silver halide emulsion layer on one side of the support and a gelatine-containing NC layer on the other side of the support, in which the NC layer contains a certain hydrophilic polymer, is distinguished by the fact that there is relatively little $E_a$ curl during drying whereas sufficient $E_i$ curl is present after drying, so that the material is not damaged during processing.

3 Claims, 1 Drawing Sheet

PHOTOGRAPHIC MATERIAL COMPRISING AN NC LAYER

INTRODUCTION

This invention relates to a photographic material, more particularly a photographic recording material, comprising an NC layer which is designed in such a way that damage to the material, particularly during the drying step of the processing cycle, is avoided or at least reduced.

BACKGROUND OF THE INVENTION

Photographic recording materials, for example microfilm or roll film, consist of a transparent support, for example of cellulose triacetate, and a plurality of layers applied to one side of the support. The layers consist essentially of gelatine in which the photographically important constituents, such as silver halide crystals, color couplers and other substances, are embedded.

These materials have a tendency when dry to curl in such a way that the emulsion side, i.e. that side of the support to which the photographically important gelatine layers are applied, lies on the inside ($E_i$ state). This tendency to curl is intentional and is brought about in the production of the material by the tractive force which the gelatine exerts during drying. To ensure that this tendency to curl does not become excessive, so-called NC (non-curling) layers are applied to the back of the support, counteracting the tendency to curl and ensuring that the film lies sufficiently flat in the camera or printer (copier) to avoid blurring during exposure and copying.

The NC layers typically consist of gelatine. It has now been found that, in the processing of materials of the type in question, the NC layers, which have a thinner coating of gelatine than the front layers, dry more quickly than the front layers and, as a result, exert a tractive force which causes the film to curl in such a way that the photographically important gelatine layers (=emulsion side) curl outwards in the meantime ($E_a$ state), so that emulsion layers can easily be damaged, particularly in the drying section of compact laboratories, so-called "minilabs", unless the film is guided over a relatively long distance (about 50 cm) between pairs of rollers during drying. In the extreme case, the end of the film, which is not additionally guided, can enter the paired transport rollers at the dryer exit obliquely and still with a pronounced curve so that the film can develop kinks.

Compact laboratories are normally laid out in such a way that the beginning of a film to be processed is attached to a perforated carrier tape and is transported through the laboratory with that tape. The end of the film is freely movable. The film is generally dried with air heated to around 50° C.

BRIEF DESCRIPTION OF THE DRAWING

FIG. 1 shows the idealized trend of a drying curve in which the time T in minutes is plotted on the abscissa while the curl in mm (height of the middle of the film above the base formed from the edges of the film) is plotted on the ordinate. The curl $E_i$ has a positive sign while the curl $E_a$ has a negative sign. The following values are read off:

Ao [mm]: initial curl

Figure 1:
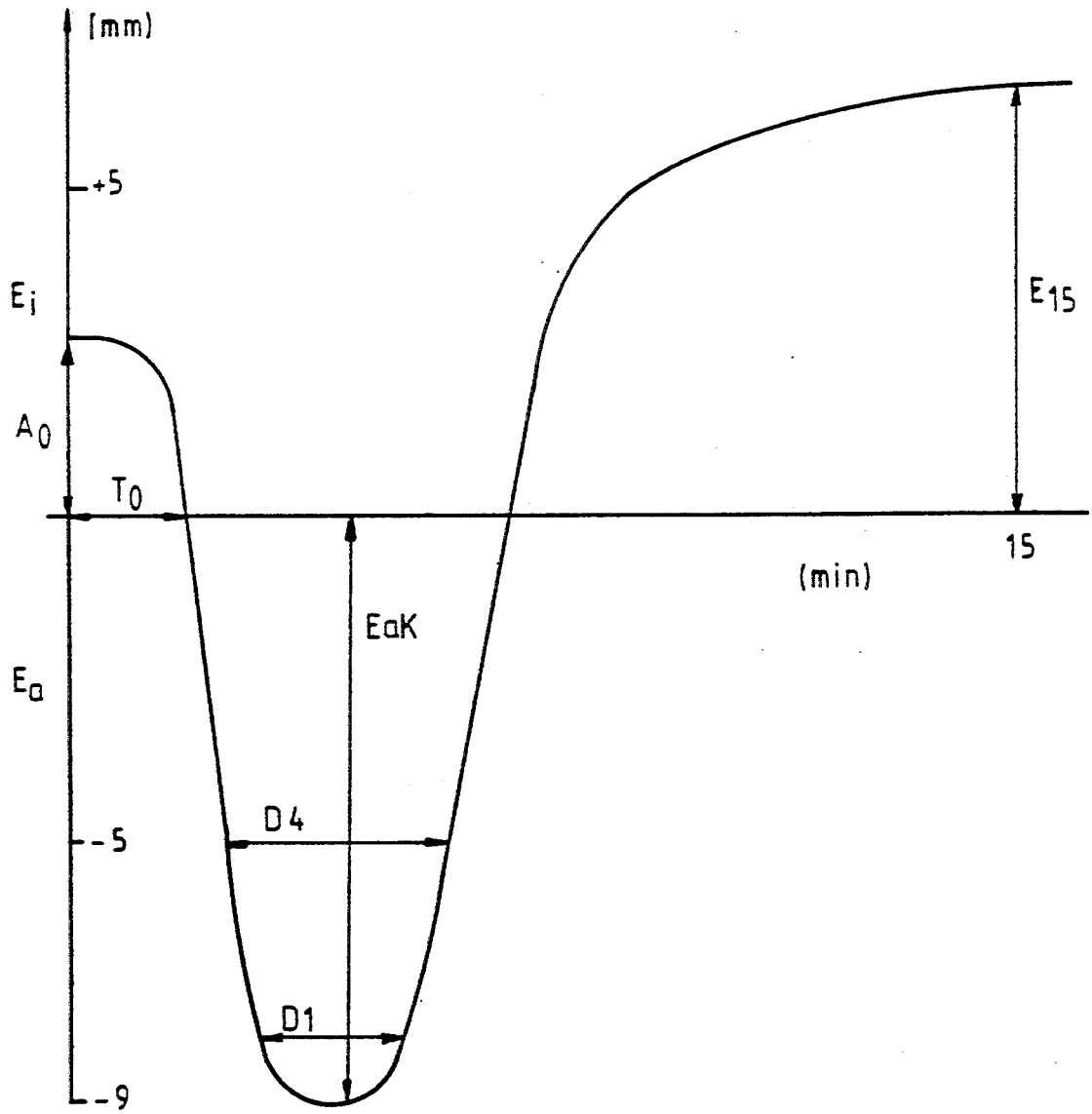
FIG. 1 is a graph illustrating film curling plotted against time for an embodiment of this invention.

To [min.]: passage through the zero line (change in curvature $E_i$ to $E_a$).

$E_aK$ [mm]: maximum $E_a$ curl $D_1$ [min.]: duration of curl 1 mm over $E_aK$ $D_4$ [min.]: duration of curl 4 mm over $E_aK$ $E_{15}$ [mm]: curl after 15 minutes (end point).

All the values were determined during drying with air at 50° C.

The problem addressed by the present invention was to modify the onset and extent of the $E_a$ curl occurring during drying at least in such a way that the emulsion layers would suffer no further damage. At the same time, however, there would be no increase in the $E_i$ curl of the film before or after processing because this would aversely affect the lay-flat property of the film in the camera or printer.

SUMMARY OF THE INVENTION

It has not been found that the problem stated can be solved by adding a certain hydrophilic polymer to the NC layer and maintaining certain quantitative ratios in regard to the gelatine on the emulsion side to the gelatine in the N layer to the polymer according to the invention.

Accordingly, the present invention relates to a photographic recording material comprising a support, at least one photosensitive, gelatine-containing silver halide emulsion layer on one side of the support and a gelatine-containing NC layer on the other side of the support, characterized in that the NC layer contains at least one hydrophilic polymer of which at least 60% by weight corresponds to the following formula

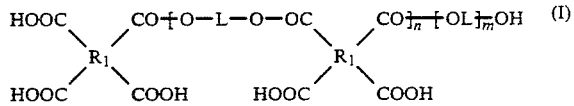

(I)

in which $R_1$ represents alkylene, arylene, aralkylene or cycloalkylene,

L is the residue of a polyester diol having an average molecular weight of 500 to 20,000, m=0 or 1, n=0 to 30 and preferably 0 to 10 and $m+n \geqq 1$, in a quantity of 0.9 to 4 g/m$^2$, the ratio by weight of gelatine on the emulsion side to gelatine in the NC layer being 2 to 3:1 and the ratio by weight of gelatine in the NC layer to the hydrophilic polymer being 2 to 5:1.

DETAILED DESCRIPTION

The quantities and polymer and gelatine should preferably be adapted to one another in such a way that the ratio of the water absorption capacity of the layers on the emulsion side to the water absorption capacity of the NC layer (ΔWAC) is 1 to 1.5:1.

In a particularly preferred embodiment, the polymer of formula I makes up at least 90% by weight of the quantity of the hydrophilic polymer.

The photographic material according to the invention is preferably a color photographic silver halide recording material comprising at least one red-sensitive layer with which at least one cyan coupler is associated, at least one green-sensitive layer with which at least one magenta coupler is associated and at least blue-sensitive layer with which at least one yellow coupler is associated, the total amount of gelatine on the photosensitive side of the support being from 12 to 18 g/m² and, in the NC layer, from 4 to 8 g/m².

However, the photographic material according to the invention may also be black-and-white silver halide recording material in which the total amount of gelatine on the photosensitive side of the support is from 8 to 12 g/m² and, in the NC layer, from 3 to 6 g/m².

The polymers corresponding to formula I have acid values of 30 to 340 and preferably 50 to 200 mg KOH/g.

The compounds corresponding to formula I are prepared by reaction of polyester diols corresponding to formula II with carboxylic anhydrides corresponding to formula III or corresponding di- and tetracarboxylic acids at temperatures of 20° to 200° C. in a molar ratio of 1:1 to 1:2, optionally in inert solvents:

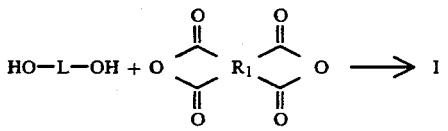

(II) (III)

The condensation reaction is preferably carried out in the absence of a solvent, more particularly at temperatures of 50° to 150° C.

The alkyl groups contain in particular 1 to 4 carbon atoms.

The polyester diols II are known, for example, from Ullmanns Enzyklopädie der technischen Chemie, 4th Edition, Vol. 19, pages 305 et seq. They are prepared by polycondensation of one or more diols with one or more dicarboxylic acids and/or one or more hydroxy acids. Diols and dicarboxylic acids are preferably used. The hydroxy acids may be used as lactones.

Examples of diols are polyalkylene glycols in which the alkylene group contains 2 to 4 carbon atoms, such as diethylene glycol, triethylene glycol, polyethylene glycol (average molecular weight approx. 200 to 1,000), 1,2-propylene glycol, 1,3-propylene glycol, polypropylene glycol (average molecular weight approx. 170 to 1,000), or diols corresponding to the following general formula $$HO—R_2—OH$$

in which $R_2$ is a difunctional hydrocarbon radical containing 2 to 13 carbon atoms, such as linear or branched alkylene groups or cycloalkylene groups (such as ethylene, propylene, butylene, isobutylene, pentylene, neopentylene, octylene, tridecylene and cyclohexylene groups) and groups substituted by one or more alkoxy groups containing 1 to 4 carbon atoms (such as ethoxy or propoxy groups), phenyl groups which may be substituted by one or more alkoxy groups, as described above, such as ethylene glycol, propylene glycol, butane-1,4-diol, isobutylene diol, dihydroxyacetone, pentane-1,5-diol, neopentyl glycol, hexane-1,6-diol, heptane-1,7-diol, octane-1,8-diol, nonane-1,9-diol, decane-1,10-diol, undecane-1,11-diol, dodecane-1,12-diol, tridecane-1,13-diol, cis- and trans-cyclohexane-1,4-diol, bisphenol A, 1,4-bis-(β-hydroxyethoxy)-benzene and 1,4-bis-(β-hydroxyethoxy)-cyclohexane.

Ethylene glycol, propane-1,2-diol, butane-1,3-diol, butane-1,4-diol, hexane-1,6-diol, neopentyl glycol, diethylene glycol are preferred.

Special examples of suitable dicarboxylic acids are carbonic acid and compounds corresponding to the following general formula $$HOOC—(R_3)_q—COOH$$

in which $R_3$ is a difunctional hydrocarbon radical containing up to 12 carbon atoms, for example a linear or branched alkylene group or cycloalkylene group (for example a methylene, ethylene, propylene, pentylene, nonylene, dodecylene or 1,1,3-trimethyl cyclopentylene group), a group corresponding to the following general formula $$—R_4—\overset{\overset{\displaystyle O}{\|}}{C}—R_5—$$

in which $R_4$ and $R_5$ each represent a linear or branched alkylene group containing up to 11 carbon atoms (for example a methylene or ethylene group), an alkenylene group (for example a —CH=CH—, propenylene or 1-butenylene group), a phenylene group which may be substituted by one or more halogen atoms (for example a phenylene or tetrachlorophenylene group) or an alkynylene group (for example a —C≡C— or —C≡C—C-group), and q has the value 0 or 1, such as oxalic acid, malonic acid, succinic acid, glutaric acid, dimethyl malonic acid, adipic acid, pimelic acid, suberic acid, α,α-dimethyl succinic acid, acetyl malic acid, acetone dicarboxylic acid, azelaic acid, sebacic acid, nonane dicarboxylic acid, decane dicarboxylic acid, undecane dicarboxylic acid, dodecane dicarboxylic acid, fumaric acid, maleic acid, itaconic acid, phthalic acid, isophthalic acid, tetrachlorophthalic acid, mesaconic acid, isopimelic acid, acetylene dicarboxylic acid, glutaconic acid.

Preferred dicarboxylic acids are succinic acid, adipic acid, phthalic acid, sebacic acid, dodecanedicarboxylic acid.

The lactone of a hydroxycarboxylic acid may be caprolactone for example.

The average molecular weight—determined from the OH value by the terminal group method—of the polyester diols corresponding to formula (II) is in the range from about 500 to 20,000 and preferably in the range from 800 to 5,000. The molar ratio of polyhydric to polybasic carboxylic acid is greater than 1. Examples of polyester diols are shown in Table 1.

TABLE 1

| | Polyester diols (II) | | | |
|---|---|---|---|---|
| Polyester diol | Dicarboxylic acid | Diol | Average molecular weight | OH value |
| II-1 | Adipic acid | Butane-1,4-diol | 1,500 | 75 |

TABLE 1-continued

Polyester diols (II)

| Polyester diol | Dicarboxylic acid | Diol | Average molecular weight | OH value |
|---|---|---|---|---|
| II-2 | Adipic acid | Neopentyl glycol | 1,700 | 66 |
| II-3 | Succinic acid | Ethylene glycol | 2,000 | 56 |
| II-4 | Adipic acid | Propylene glycol | 1,200 | 93 |
| II-5 | Sebacic acid | Ethylene glycol | 3,500 | 32 |
| II-6 | Dodecane dicarboxylic acid | Ethylene glycol | 1,900 | 59 |
| II-7 | Succinic acid | Hexanediol | 800 | 140 |
| II-8 | Adipic acid | Diethylene glycol | 2,400 | 46 |
| II-9 | Succinic acid | Neopentyl glycol | 4,200 | 27 |
| II-10 | Adipic acid | Butane-1,4-diol/neopentyl glycol 50:50* | 3,200 | 35 |
| II-11 | Adipic acid/phthalic acid 50:50* | Ethylene glycol | 2,000 | 56 |
| II-12 | Adipic acid | Butane-1,4-diol/butane-1,3-diol 50:50* | 2,900 | 39 |

*mol-%

The following are examples of carboxylic anhydrides corresponding to formula (III):

III-1

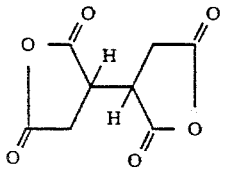

III-2

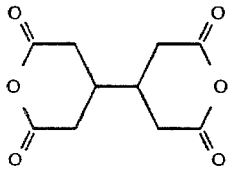

III-3

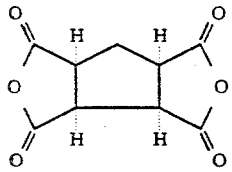

III-4

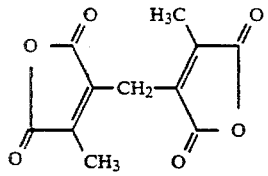

III-5

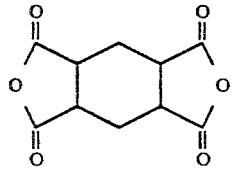

III-6

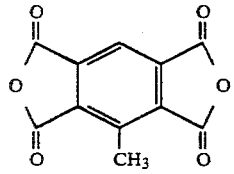

-continued

III-7

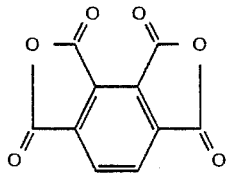

III-8

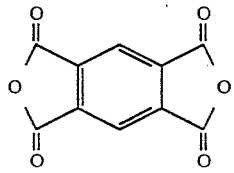

III-9

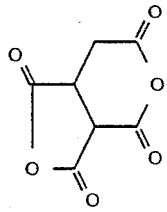

III-10

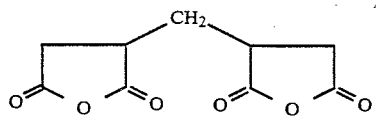

III-11

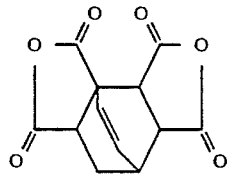

III-12

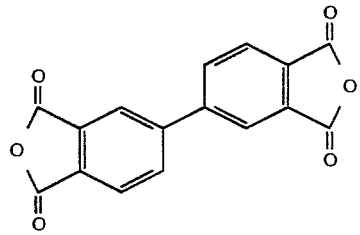

-continued

III-13

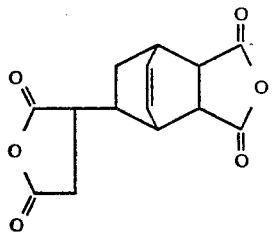

III-14

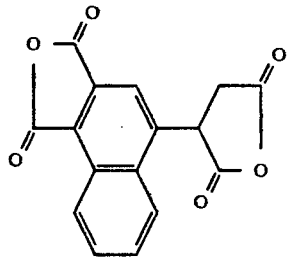

III-15

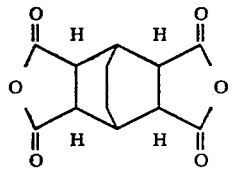

III-16

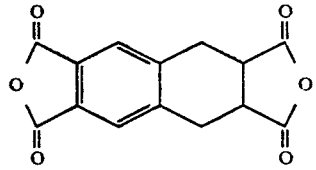

III-17

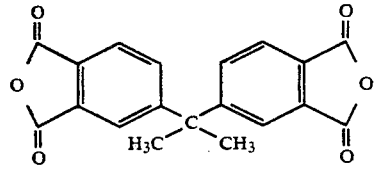

Other suitable hydrophilic polymers, of which the hydrophilic polymer according to the invention may contain up to 40% by weight and preferably up to 10% by weight, are both naturally occurring high molecular weight compounds, such as proteins, protein derivatives, cellulose derivatives, for example cellulose esters, gelatine derivatives, for example acetylated gelatine, phthaloyl gelatine, ureido gelatine, polysaccharides, for example dextran, gum arabic, casein, collagen derivatives, albumin, as described in Research Disclosure, December 1989, pages 1003–1004.

The NC layer may also contain plasticizers. Suitable plasticizers are monohydric and polyhydric alcohols; acid amides; esters, for example phosphate esters, such as tricresyl phosphate; phthalate esters, such as for example dibutyl phthalate; polyacrylates, such as polybutyl acrylate, polyethyl acrylate; polyurethane latices containing anionic, cationic or nonionic groups, as described in Research Disclosure 12/89, page 1006.

In addition, the NC layer may contain aqueous microgels. Aqueous microgels are water-swellable particles having an average particle diameter below 1 μm. Examples of microgels are crosslinked polystyrene sulfonic acid salts, crosslinked poly(meth)acrylic acid salts, crosslinked poly(meth)acrylamides, crosslinked polymers containing quaternary ammonium groups.

The NC layer according to the invention may be made up of one or more layers, for example two or three layers. In the case of a multilayer structure, the "NC layer" is always understood to be the NC layer combination as a whole.

EXAMPLE 1 (COMPARISON)

A 95 μm thick cellulose triacetate support provided on both sides with an adhesive layer is coated on its front side with a photosensitive, three-color color combination, dry layer thickness 21.5 μm; gelatine coating 16.9 g/m$^2$.

An NC layer having the following composition is cast onto the back of the support:

| | | |
|---|---|---|
| 1. A layer of: | 0.9 | g/m$^2$ gelatine |
| | 0.01 | g/m$^2$ triacryl formal |
| | 0.005 | g/m$^2$ wetting agent |
| (pH of the casting solutions 6.3) | | |
| 2. A middle layer of: | 5.1 | g/m$^2$ gelatine |
| | 0.06 | g/m$^2$ triacryl formal |
| | 0.01 | g/m$^2$ wetting agent |
| (pH of the casting solution 6.3) | | |
| 3. An outer layer of: | 0.2 | g/m$^2$ gelatine |
| | 0.76 | g/m$^2$ polymer 2 |
| | 0.001 | g/m$^2$ triacryl formal |
| | 0.011 | g/m$^2$ wetting agent (Manoxol) |
| | 0.076 | g/m$^2$ sodium bicarbonate |
| | 0.072 | g/m$^2$ sodium hydroxide |
| Total gelatine coating of the NC layer: 6.2 g/m$^2$. | | |

The dry layer thickness of the NC layer is 5.4 μm. The layer is applied in one pass in a three-stage cascade. The drying properties of the roll film thus produced are shown in Table 2.

35 mm wide strips are cut from the coated material (60 cm wide). The strips are then exposed, developed, bleached, fixed, washed and dried.

During processing, scratches in the emulsion layer and lateral kinks are formed in the dryer (for example of a Noritzu Minilab (type QSF-B50L-3)).

In order to find the causes, the film—after wet processing and removal of adhering water by stripping—was hung up to dry at 50° C. in a standard drying cabinet with a hot air fan. The end of the film (overall length 80 cm) is weighted by a clip weighing approximately 20 g.

The curling of the film is measured initially at 1 minute intervals, then every 20 seconds during the curling phase and, thereafter, at intervals of 1 minute. The values (curling against time) are plotted against one another and made up into a curve. The values $A_o$, $T_o$, $E_aK$, $D_1$, $D_4$ and $E_{15}$ defined with reference to FIG. 1 are read off from the curve.

The tests show that, after drying, undamaged films which assume a good flat position during copying are only obtained in the Noritzu Minilab when $T_o \geqq 2.2$, $D_1 \leqq 1.5$, $E_{15} = 4.0-7.0$ and $E_aK < 10$.

The values of Example 1 are shown in Table 2 below.

EXAMPLES 2–4 (COMPARISON)

If only the gelatine coating of the NC layer is increased, $T_o$ and $E_aK$ are modified as required, but the film now shows excessive $E_a$ before and after development. As a result, it does not lie flat during copying at room temperature.

The gelatine coatings and results are shown in Table 2.

TABLE 2

| Example | Quantity of gelatine in NC layer [g/m²] | $T_o$ | $A_o$ | $E_oK$ | $D_1$ | $D_4$ | $E_{15}$ | ΔWAC |
|---|---|---|---|---|---|---|---|---|
| 1 | 6.2 | 3.0 | 1.4 | −11.6 | 1.5 | 2.5 | 5.6 | 2.5 |
| 2 | 7.2 | 4.4 | 1.4 | −8.2 | 1.4 | 2.5 | 5.0 | 2.1 |
| 3 | 10.6 | 5.0 | 1.4 | −8.6 | 0.9 | 2.1 | 1.8 | 1.6 |
| 4 | 16.9 | 6.3 | 1.4 | −4.7 | 0.5 | | −0.7 | 1.0 |

EXAMPLES 5-7 (INVENTION)

The same photosensitive three-color combination of Example 1 is applied to the front of a 95 μm thick triacetate support provided with an adhesive layer on both sides. Different NC layers, in which various polymers or mixtures of polymers are added in addition to the gelatine in layer 2, are applied to the back of the triacetate support.

The quantities of the polymers and the gelatine and the results are shown in Table 3.

Scratches on the emulsion side and kinks are not observed during passage through the dryer mentioned in Example 1.

TABLE 3

| Example | Quantity of gelatine in NC layer [g/m²] | Polymer | Quantity of polymer [g/m²] | $A_o$ | $T_o$ | $E_oK$ | $D_1$ | $D_4$ | $E_{15}$ | ΔWAC |
|---|---|---|---|---|---|---|---|---|---|---|
| 5 | 7 | 1 | 2 | 1.4 | 2.3 | −8.8 | 1.2 | 2.2 | 6.9 | 1.44 |
| 6 | 7 | 1 | 2 | 1.4 | 3.3 | −8.9 | 1.1 | 1.8 | 4.4 | 1.39 |
| | | 2 | 1 | | | | | | | |
| 7 | 7 | 1 | 2 | 1.4 | 2.6 | −7.9 | 1.1 | 2.0 | 7.6 | 1.47 |
| | | 3 | 1 | | | | | | | |

Polymer 1 is a reaction product of a polyester diol of adipic acid and neopentyl glycol with benzene-1,2,4,5-tetracarboxylic acid, acid value 73.

Polymer 2 is a polymer corresponding to the following formula

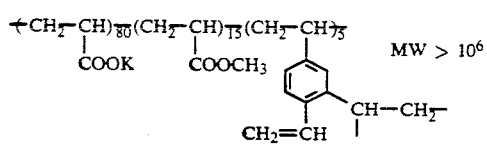

Polymer 3 is a polyester urethane of a polyester diol, hexamethylene diisocyanate and diaminocaproic acid, the polyester diol being prepared from adipic acid and neopentyl glycol (MW: 80,000).

EXAMPLE 8

An additional advantage of the NC layer according to the invention is the reduction in the lay-flat amplitude, i.e. the moisture-dependent curl of the film is smaller. As shown in Table 4, the lay-flat difference in the 50 to 20% moisture range of particular practical importance is distinctly greater in the starting film of Example 1 than in the comparison films having NC layers containing polymer 1 according to the invention on its own or blended with another polymer.

TABLE 4

| Roll film acc. to | Curvature 50% r.h. | [100/R = m⁻¹] 20% r.h. | Amplitude 50% − 20% r.h. |
|---|---|---|---|
| Example 1 | 23 | 42 | 19 |
| Example 5 | 29 | 37 | 8 |
| Example 6 | 22 | 18 | 4 |
| Example 7 | 29 | 39 | 10 |

We claim:

1. A photographic recording material comprising a support, at least one photosensitive, gelatine-containing silver halide emulsion layer on one side of the support and a gelatine-containing NC layer on the other side of the support, wherein the NC layer contains at least one hydrophilic polymer of which at least 60% by weight corresponds to the following formula

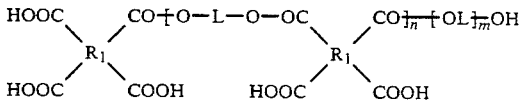

(I)

in which $R_1$ represents alkylene, arylene, aralkylene or cycloalkylene,

L is the residue of a polyester diol having an average molecular weight of 500 to 20,000, m=0 or 1, n=0 to 30 and preferably 0 to 10 and m+n≧1, in a quantity of 0.9 to 4 g/m², the ratio by weight of gelatine on the emulsion side to gelatine in the NC layer being 2 to 3:1 and the ratio by weight of gelatine in the NC layer to the hydrophilic polymer being 2 to 5:1.

2. A photographic recording material as claimed in claim 1, wherein the ratio of the water absorption capacity of the layers on the emulsion side to the water absorption capacity of the NC layer (a WAC) is 1 to 1.5:1.

3. A photographic recording material as claimed in claim 1, wherein it is a color photographic silver halide recording material comprising at least one red-sensitive layer with which at least one cyan coupler is associated, at least one green-sensitive layer with which at least one magenta coupler is associated and at least blue-sensitive layer with which at least one yellow coupler is associated, the total amount of gelatine on the photosensitive side of the support being from 12 to 18 g/m² and, in the NC layer, from 4 to 8 g/m².

* * * * *